US008564490B2

(12) United States Patent
Miyagawa et al.

(10) Patent No.: US 8,564,490 B2
(45) Date of Patent: Oct. 22, 2013

(54) ANTENNA DEVICE AND RADAR APPARATUS

(75) Inventors: Tetsuya Miyagawa, Nishinomiya (JP); Koji Yano, Nishinomiya (JP); Makoto Oda, Nishinomiya (JP); Takashi Omori, Nishinomiya (JP); Motoji Kondo, Nishinomiya (JP); Masato Sakamoto, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 432 days.

(21) Appl. No.: 13/015,909

(22) Filed: Jan. 28, 2011

(65) Prior Publication Data

US 2011/0248883 A1 Oct. 13, 2011

(30) Foreign Application Priority Data

Apr. 9, 2010 (JP) ..... 2010-090773

(51) Int. Cl.
*H01Q 13/10* (2006.01)

(52) U.S. Cl.
USPC ..... 343/771; 343/784

(58) Field of Classification Search
USPC ..... 343/767, 771, 772, 784
See application file for complete search history.

(56) References Cited

U.S. PATENT DOCUMENTS

| | | | | |
|---|---|---|---|---|
| 4,872,019 | A | 10/1989 | Chow et al. | |
| 6,411,258 | B1 * | 6/2002 | Ho | 343/700 MS |
| 6,731,241 | B2 * | 5/2004 | Park et al. | 342/361 |
| 6,947,003 | B2 * | 9/2005 | Huor | 343/770 |
| 2009/0121952 | A1 | 5/2009 | Shibuya et al. | |

FOREIGN PATENT DOCUMENTS

| | | | |
|---|---|---|---|
| JP | 55 151801 | A | 11/1980 |
| JP | 2007-110201 | A | 4/2007 |

* cited by examiner

*Primary Examiner* — Hoang V Nguyen
(74) *Attorney, Agent, or Firm* — Birch, Stewart, Kolasch & Birch, LLP

(57) ABSTRACT

The disclosure provides an antenna device, which includes a waveguide antenna having wall surfaces and for emitting a radio wave in a direction substantially perpendicular to an emission face that is one of wall surfaces of the waveguide antenna extending in an elongated direction of the waveguide antenna, a plate-shape two-dimensional opening slots for beam formation formed in the waveguide antenna on the emission face side, a power feed waveguide module arranged in the rear face of the waveguide antenna opposite from the emission face and for supplying electric power to the waveguide antenna, and a cylindrical radome having a substantially circular cross-section of a diameter that is substantially equal to a length of the emission face in a direction perpendicular to the long-side direction so that the waveguide antenna is contained in the radome so as to be arranged at substantially the center of the radome.

15 Claims, 6 Drawing Sheets

ANTENNA DEVICE AND RADAR APPARATUS

CROSS-REFERENCE TO RELATED APPLICATION(S)

The application claims priority under 35 U.S.C. §119 to Japanese Patent Application No. 2010-090773, which was filed on Apr. 9, 2010, the entire disclosure of which is hereby incorporated by reference.

TECHNICAL FIELD

The present invention relates to an antenna device for transmitting and receiving a radio wave, and, more particularly to the antenna device that is formed in an elongated shape, and transmits and receives the radio wave while rotating in a plane including an axis of the elongated shape.

BACKGROUND

Typically, radar apparatuses are provided with an antenna that emits (transmits) a radio wave at a predetermined frequency in response to supply of electric power for emission, and receives the radio wave from the outside such as a reflection wave of the transmission wave. Typically, the antenna is installed outside. For this reason, it is necessary to provide a radome for covering the antenna to protect the antenna from external environment. The radome is a must especially for an antenna of a ship radar apparatus mounted on a ship because it is exposed to severe external environment.

JP2007-110201A discloses a structure of an antenna and a radome for covering the antenna. The radome of the antenna device disclosed in JP2007-110201A is formed in a substantially elongated cuboid shape. Inside the radome, an elongated waveguide antenna and a horn provided on the emission face side of the waveguide antenna are arranged.

However, in the conventional antenna device as disclosed in JP2007-110201A, in order to obtain desired vertical radiation pattern, a length in an emitting direction of a horn is needed to be about 3λ or more (here, a wavelength of the emission radio wave is λ). On the other hand, the horn also spreads in the vertical direction to some extent; however, the vertical direction does not require an opening length as much as an opening length in the emitting direction. Therefore, the horn has a long depth in a horizontal direction perpendicular to the elongated direction of the horn, and, on the other hand, it has a height in the vertical direction, which is not so long as the depth.

For this reason, the radome of the conventional antenna device is typically formed in an elongated shape, as well as a flat shape where the size of the radome is significantly large as compared with the size of a waveguide antenna, and the height is low and the depth is long. In addition, the weight of the antenna device including the radome is heavy.

SUMMARY

Therefore, the present invention is to provide a small-sized, light-weight antenna device of an elongated shape, and to provide a radar apparatus provided with the antenna device.

According to one aspect of the invention, an antenna device is provided, which includes a waveguide antenna having wall surfaces and for emitting a radio wave in a direction substantially perpendicular to an emission face that is one of wall surfaces of the waveguide antenna extending in an elongated direction of the waveguide antenna, a plate-shape two-dimensional opening slots for beam formation formed in the waveguide antenna on the emission face side, a power feed waveguide module arranged in the rear face of the waveguide antenna opposite from the emission face and for supplying electric power to the waveguide antenna, and a cylindrical radome having a substantially circular cross-section of a diameter that is substantially equal to a length of the emission face in a direction perpendicular to the elongated direction so that the waveguide antenna is contained in the radome so as to be arranged at substantially the center of the radome.

With this configuration, the two-dimensional opening slot is provided, but a horn is not provided. Therefore, the length in a direction perpendicular to the emission face of the waveguide antenna can be shorter. Furthermore, the power feed waveguide module is provided on the rear side of the waveguide antenna, and the electric power is supplied to the waveguide antenna from the rear side. Therefore, the length in a direction parallel to the emission face will be shorter rather than providing the power feed path from the power feed waveguide module to the waveguide antenna at an end portion parallel to the emission face of the waveguide antenna.

Thus, by using the radome having the substantially circular side cross-section of a diameter substantially equal to the length in the direction perpendicular to the elongated direction of the emission face of the waveguide antenna, if the waveguide antenna is arranged at substantially the center of the substantially circular shape, the waveguide antenna, the two-dimensional slot array, and the power feed waveguide module can be contained in the radome.

Here, since the waveguide antenna has the length (depth) in the direction perpendicular to the emission face (rear face) which is shorter than the length (height) in the direction parallel to the emission face and perpendicular to the elongated direction, even if the power feed waveguide module is provided in the rear face, the power feed waveguide module can also be stored in the radome having the circular side cross-section, without hardly affecting the size of the radome.

As described above, if the configuration of this aspect of the invention is used, the radome having the circular cross-section of the diameter substantially equal to the size of the side cross-section of the waveguide antenna can be achieved, thereby the antenna device is reduced in size and weight.

The antenna device may further include a rotating module for rotating an integrated structural body including the waveguide antenna, the two-dimensional opening slot, the power feed waveguide module, and the radome that contains these so that the elongated direction is in a surface of the rotation.

The radome may include an emission face side radome of a substantially semi-circular side cross-section on the emission face side. The emission face side radome may include an outer wall of a substantially semi-circular side cross-section, and an inner wall arranged inside of the outer wall between the outer wall and the antenna, and formed in a shape substantially conforming to the outer wall. A gap between the outer wall and the inner wall may be wider near both ends on the circumference of the substantially semi-circular shape than at a substantially midpoint on the circumference of the substantially semi-circular shape.

The gap may be constant in a prescribed range from the midpoint up to prescribed positions toward both the ends, and may be widened as approaching both the ends from the prescribed range.

The inner wall of the radome may include a first inner wall formed up to the prescribed position, with a constant gap from the outer wall, and a second inner wall extending from the prescribed position as one end thereof and having a cross-section parallel to a direction from the substantially midpoint toward the center of the substantially semi-circular shape.

The power feed waveguide module may include a first power feed waveguide for transmitting a radio wave in a predetermined mode inputted from the outside, and a mode conversion waveguide for carrying out a mode conversion of the radio wave in the predetermined mode from the first power feed waveguide into an emission mode for the waveguide antenna. The mode conversion waveguide may be coupled to the waveguide antenna by power feed opening slots in the rear face of the waveguide antenna.

The mode conversion waveguide may include a coupling resonance module for coupling to the first power feed waveguide, and a power feed resonance module coupled to the waveguide antenna via the power feed opening slots. A matching module for matching with the coupling resonance module may be provided inside the power feed resonance module.

According to another aspect of the invention, a radar apparatus is provided, which includes any of the antenna devices, and a radio wave generating device for generating an emission radio wave for supplying electric power to the antenna device. The antenna device is provided so that the emission face of the waveguide antenna is oriented perpendicular to a horizontal direction and an antenna rotates in a horizontal plane while emitting electromagnetic wave horizontally.

By using such an antenna device reduced in size and weight, if the rotation is more stabilized, radio wave emission properties can be improve and target object detection characteristics as the radar apparatus can also be improved.

As described above, according to the aspects of the invention, the antenna device of the elongated shape and the radar apparatus including the antenna device, which are reduced in size and weight having characteristics equal to or better than the conventional structure can be achieved.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

An antenna device according to one embodiment of the present invention is described with reference to the accompanying drawings. Note that, although a case where a radio wave is emitted from the antenna device is described below as an example, it should be appreciated that the antenna device can receive the radio wave from the outside as well.

The antenna device 1 of this embodiment is to be used for a ship radar apparatus, where a transmission wave at a predetermined frequency which is generated by a transmission radio wave generating device, such as a magnetron (not illustrated) is supplied. The antenna device 1 is typically installed on a deck or a pilothouse of a ship provided with the radar apparatus.

Figure 1:
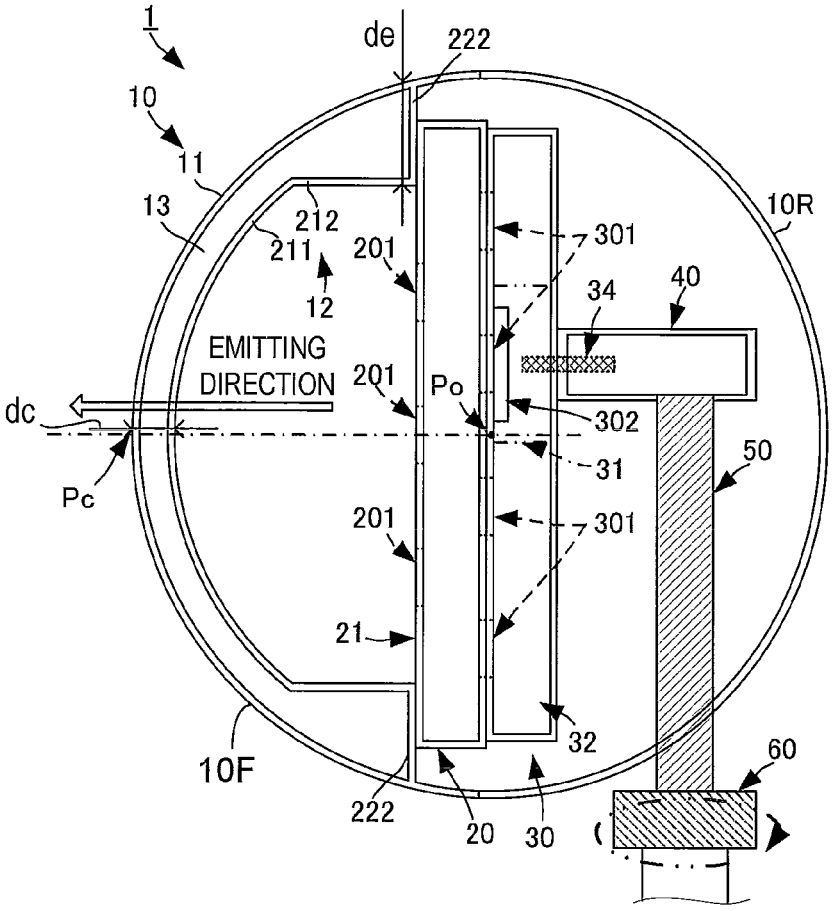
FIG. 1 is a side cross-sectional view of an antenna device according to one embodiment of the present invention.
Figure 2A:
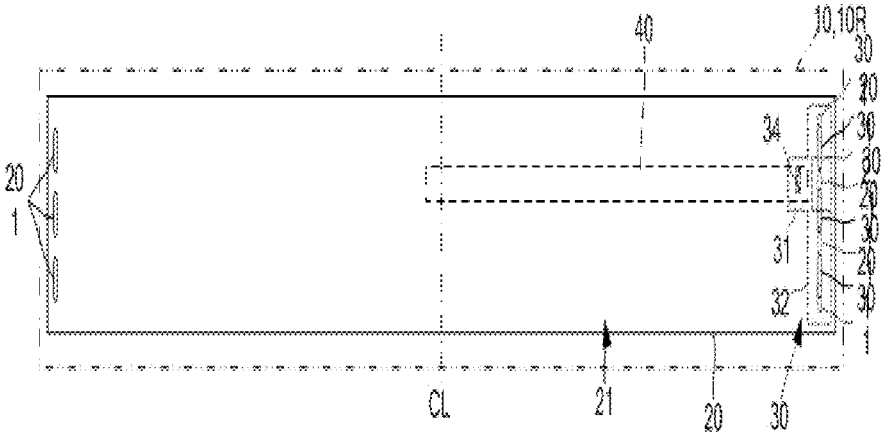
FIGS. 2A and 2B are a transparent front view and a transparent rear view of radomes of the antenna device according to the embodiment of the present invention, respectively.
Figure 2B:
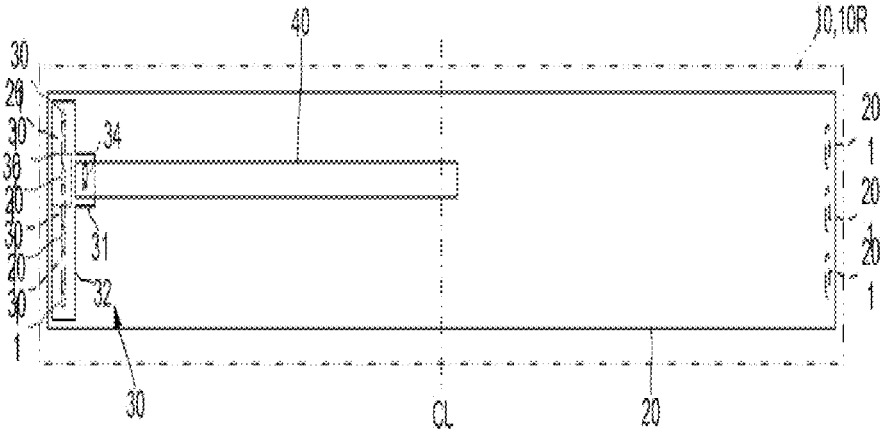
Figure 3A:
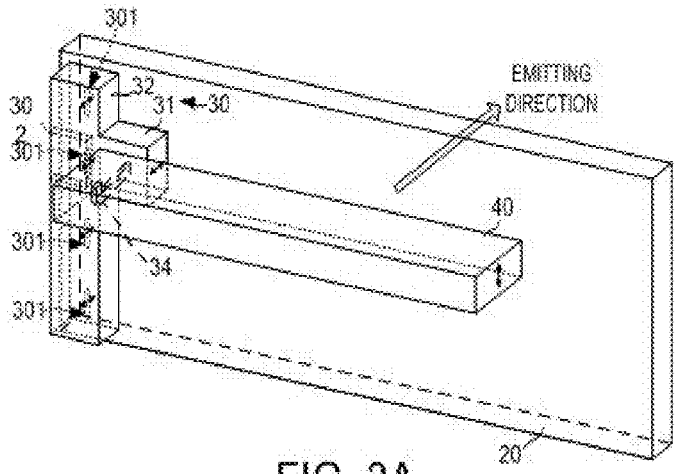
FIGS. 3A and 3B are a perspective view and a view showing an electric field distribution, from the rear side, where the radomes of the antenna device according to the embodiment of the present invention are removed.
Figure 3B:
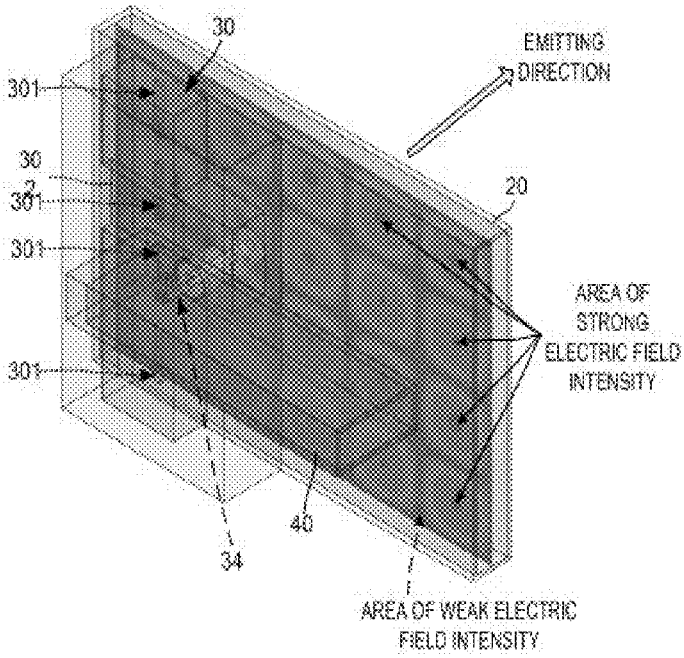

FIG. 1 is a side cross-sectional view of the antenna device 1. FIG. 2A is a transparent front view of a radome 10 of the antenna device 1, and FIG. 2B is a transparent rear view of the radome 10. FIG. 3A is a perspective view from the rear side where the radome 10 is removed, and FIG. 3B is a view showing an electric field distribution of a slot waveguide antenna 20.

The antenna device 1 includes a two-dimensional slot antenna 20 of an elongated shape, a mode conversion waveguide 30, a first waveguide 40, a coaxial cable path 50, and a rotary joint 60. The two-dimensional slot antenna 20, the mode conversion waveguide 30, the first waveguide 40, and a part of the coaxial cable path 50 are arranged inside the radome 10 having a circular side cross-section.

The two-dimensional slot antenna 20 is formed in a rectangular body having an elongated outside shape, and includes a two-dimensional slot forming member and a waveguide antenna. The waveguide antenna includes a main waveguide formed in a rectangular cylinder of an elongated shape and an emission waveguide. The main waveguide is formed with a pair of walls which are long sides when seen in its longitudinal direction, and a pair of walls which are short sides perpendicular to the longitudinal direction. The emission waveguide is formed in one wall surface of the long side walls. The emission waveguide is formed so that its axial direction is substantially perpendicular to the axial direction of the main waveguide, and the main waveguide and the emission waveguide are electromagnetically coupled to each other by their hollow parts communicating with each other.

The two-dimensional slot forming member is provided in an opening plane of the emission waveguide of the waveguide antenna. As shown in FIGS. 2A and 2B, opening slots are two-dimensionally arranged in the two-dimensional slot member along the elongated direction and the long-side direction of the main waveguide which is perpendicular to the elongated direction. In FIG. 2, although only the opening slots at both ends in the elongated direction are shown, it should be appreciate that a number of opening slots are two-dimensionally arranged also between these opening slots by a predetermined array pattern. The array pattern of the opening slots is not limited to three rows as shown in FIGS. 2A and 2B, but it is determined based on the vertical radiation pattern which is desired as the antenna device (i.e., the radiation pattern along the long-side direction of the main waveguide). The surface where the opening slots are two-dimensionally arranged serves as an emission face 21 of the two-dimensional slot antenna 20, and a direction which is perpendicular to the emission face 21 and separates from the emission face 21 serves as an emitting direction.

A mode conversion waveguide 30 is provided in the emission face of the two-dimensional slot antenna 20 and the rear face on the opposite side. The mode conversion waveguide 30 includes a T-shaped waveguide where a coupling resonator 31 and a power feed resonator 32 of which internal spaces communicate with each other are integrally formed. The rear face of the main waveguide of the mode conversion waveguide 30 contacts one wall of the opposing T-shaped walls. Power feed slots 301 are formed in the contact surface at prescribed intervals. The power feed slots 301 electromagnetically couple the power feed resonator 32 of the mode conversion waveguide 30 to the main waveguide of the two-dimensional slot antenna 20. A height of the mode conversion waveguide 30 (i.e., a distance between the T-shaped wall surfaces) is set to be substantially the same length as the short-side length of the main waveguide of the two-dimensional slot antenna 20. Moreover, a matching convex portion 302 is formed inside the power feed resonator 32 of the mode conversion waveguide 30.

A first waveguide 40 is provided in a face of the mode conversion waveguide 30 on the opposite side from the two-dimensional slot antenna 20. The first waveguide 40 is formed in an elongated rectangular cylinder shape where one end contacts the coupling resonator 31 of the mode conversion waveguide 30 and the other end extends to a predetermined length exceeding the midpoint of the two-dimensional slot antenna 20 in the elongated direction. The first waveguide 40 is provided so that its long-side direction is oriented in the short-side directions of the main waveguide and the mode conversion waveguide 30.

A waveguide coupling member 34 is provided at the contact position of the coupling resonator 31 of the mode conversion waveguide 30 and the first waveguide 40. The waveguide coupling member 34 is formed by an L-shaped conductor plate in a side view, and is insulated by an insulator (not illustrated) from the wall of the mode conversion waveguide 30 and the wall of the first waveguide 40. Thereby, a coaxial cable path for electromagnetically connecting the coupling resonator 31 and the first waveguide 40 is formed, and, through the coaxial cable path, an electromagnetic wave propagates between the coupling resonator 31 and the first waveguide 40.

Near an end of the first waveguide 40 opposite from the mode conversion waveguide 30, a power feed waveguide 50 extending in a direction perpendicular to the first waveguide 40 (that is, extending in the above-described long-side direction) is connected. Thus, an L-shaped waveguide which bends in the propagation direction by 90° is constituted by the first waveguide 40 and the power feed waveguide 50. Thereby, the propagation along the elongated direction of the two-dimensional slot antenna 20 can be converted into the propagation along the long-side direction. It should also be appreciated that the propagation along the long-side direction can also be conversely converted into the propagation along the elongated direction.

An insulation retaining member is provided to the perimeter of the power feed waveguide 50. The insulation retaining member is formed with a structure in which an integrated structural body including respective elements constituting the antenna device 1 and the radome 10 can be installed so that the emitting direction of the two-dimensional slot antenna 20 is oriented in a substantially horizontal direction.

A rotary joint 60 is provided at a prescribed position in the axial direction of the power feed waveguide 50. By the rotary joint 60, the integrated structural body can be provided so that it rotates in a horizontal plane.

With such a configuration, when transmission electric power at a predetermined frequency is supplied from the transmission radio wave generating device such as a magnetron (not illustrated), the transmission electric power propagates along the long-side direction through the power feed waveguide 50, and then propagates to the first waveguide 40. The first waveguide 40 is excited in a TE01 mode where a direction perpendicular to the elongated direction and the emitting direction is set to be an electric field direction to propagate the transmission electric power.

The waveguide coupling member 34 converts the transmission electric power propagated inside the first waveguide 40 into a one end coaxial mode, and propagates it to the coupling resonator 31 of the mode conversion waveguide 30. The coupling resonator 31 is excited in the TE01 mode with the transmission electric power propagated by the waveguide coupling member 34. Here, the coupling resonator 31 is excited in the TE01 mode where a direction parallel to the emitting direction is set to be the electric field direction. Thereby, the transmission electric power which is constituted with the electromagnetic field in the same direction as the main waveguide of the two-dimensional slot antenna 20 can be formed.

The power feed waveguide 32 has a length which is four times of the length of the coupling resonator 31, and excites in a TE04 mode by electromagnetically coupling to the coupling resonator 31. Therefore, by the coupling resonator 31 exciting in the TE01 mode, the power feed resonator 32 is excited in the TE04 mode. Thereby, the transmission electric power which is constituted with the electromagnetic field in the same direction and in the same mode as the main waveguide of the two-dimensional slot antenna 20 can be formed. Here, by suitably setting the shape of the matching convex portion 302, a mode conversion with low loss and stable intensity distribution can be performed.

The transmission electric power in the TE04 mode excited by the power feed resonator 32 is supplied to the main waveguide of the two-dimensional slot antenna 20 via the power feed slots 301. Here, the power feed slots 301 are formed for every peak of each electric field intensity of the TE04 mode, and since the electric power is supplied from the rear side of the main waveguide, the main waveguide is excited in the TE04 mode which is the same as the power feed resonator 32.

In the two-dimensional slot antenna 20, the transmission electric power propagates inside the main waveguide in the TE04 mode, and the transmission radio wave is emitted from each emission waveguide. Here, since the emission slots 201 are formed in the predetermined array pattern as described above, the transmission radio waves emitted from the respective emission waveguides are phase-synthesized and, thus, the desired vertical radiation pattern can be achieved.

As described above, by using the configuration of this embodiment, the waveguide paths, such as each waveguide which feeds the electric power to the two-dimensional slot antenna 20, and the coaxial cable path, are arranged only on the rear side of the two-dimensional slot antenna 20 to feed the electric power securely and stably to the two-dimensional slot antenna 20. That is, the two-dimensional slot antenna 20 has a shape which becomes the largest in the elongated direction and long-side direction of the two-dimensional slot antenna 20. On the other hand, the two-dimensional slot antenna 20 can be made shorter in the short-side direction than the length in the long-side direction because the two-dimensional slot antenna 20 itself is small in size as compared with the size in the long-side direction, even if other waveguide paths are arranged.

Therefore, the radome 10 of a substantially circular shape in the side cross-sectional shape can be used, as described below.

As shown in FIG. 1, the radome 10 includes a front radome 10F and a rear radome 10R, and is formed in a cylinder shape having a circular cross-section when seen in the side view (i.e., when seen in the elongated direction). The two-dimensional slot antenna 20 is arranged at the central position of the radome 10 when seen in the side view. Thus, a diameter of the side cross-sectional shape of the radome 10 can be substantially equal to the length of the long side of the two-dimensional slot antenna 20, and can be the length so that the radome 10 contains the two-dimensional slot antenna 20.

Specifically, the radome having a diameter of about three times to four times longer than the wavelength λ of the transmission wave but five times at the maximum can be achieved. Note that, with the structure using the conventional horn, although the height becomes approximately the same as that of this embodiment, as the horizontal dimension needs to be seven to eight times or more of the wavelength.

As a result, the smaller-sized and lighter-weight antenna device 1 than before can be achieved.

Moreover, the small-sized, light-weight antenna device 1 having such a substantially circular cross-sectional shape can reduce a torque of a motor for rotating the antenna device 1, and, thereby a load reduction of the motor, and power-saving and long-life are possible.

Figure 4:
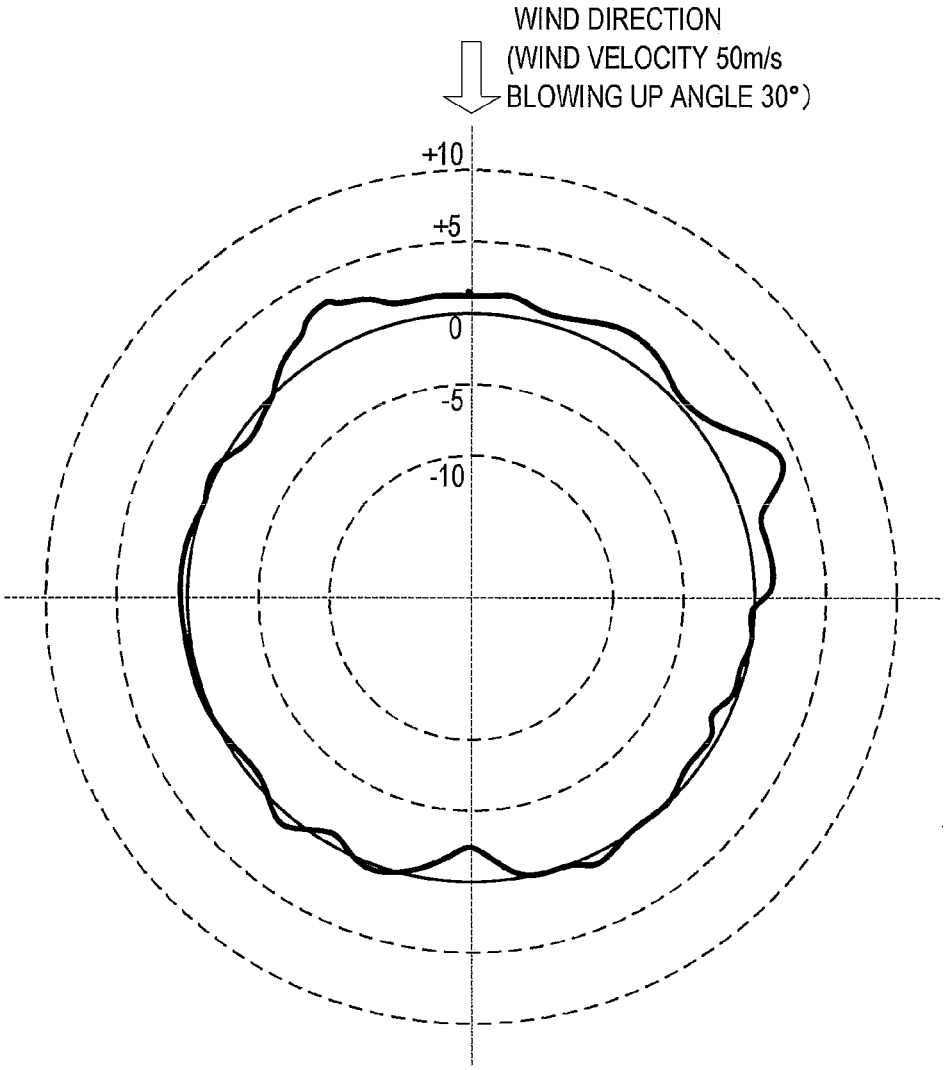
FIG. 4 is a graph showing a change in a torque according to a wind direction.

FIG. 4 is a graph showing a change of the torque according to a wind direction. As shown in FIG. 4, by using the configuration of this embodiment, the motor can be continuously rotated with a stable torque regardless of the wind direction.

Moreover, since the rotation is more stable than the conventional structure, more stable and uniform radio wave emission is possible to all the directions. As a result, a target object detection by a reflection signal of the radio wave will also be stabilized.

Furthermore, the radome 10 can further improve the vertical radiation pattern by having the following structure of the front radome 10F.

As shown in FIG. 1, the front radome 10F includes an outer wall 11 and an inner wall 12. In this embodiment, the outer wall 11 and the inner wall 12 are made of the same dielectric material.

The outer wall 11 constitutes an external wall surface of the front radome 10F, and is formed in a semi-circular shape having a radius R based on the diameter described above in the side cross-section, with a predetermined thickness.

The inner wall 12 has the predetermined thickness similar to the thickness of the outer wall 11, and includes a first inner wall 211 and second inner walls 212.

The first inner wall 211 is arranged, in the side view (refer to FIG. 1), so as to be spaced by a certain gap dc from the outer wall 11 within a range from a midpoint Pc on the circumference of the outer wall 11 to a position of a prescribed distance toward both ends Pe. That is, the first inner wall 211 is formed in an arc shape in the side cross-section having a radius shorter than that of the outer wall 11.

In this embodiment, the gap dc is set to be about ¼ of a wavelength λg of the emission radio wave in the dielectric 13 arranged between the outer wall 11 and the inner wall 12. Thereby, in this range, reflection radio waves from the outer wall 11 and the inner wall 12 cancel out with each other and, thus, a low-loss emission is possible.

On the other hand, each second inner wall 212 is formed in a flat plate shape extending from one end thereof which is an end of the first inner wall 211 corresponding to the prescribed position on the circumference, along a direction connecting the midpoint Pc of the outer wall 11 and the center Po of the outer wall 11 by a prescribed distance.

By such a structure, within the ranges between the prescribed positions and the ends Pe on the circumference, the gap between the outer wall 11 and the inner wall 12 (second inner walls 212) is gradually widened from the prescribed positions to the ends Pe. Near the ends Pe, the gaps de between the outer wall 11 and the inner wall 12 are greater than the gap dc near the midpoint.

Note that, ends of the inner wall 12 (i.e., ends on the opposite side from the joined ends of the second inner walls 212 to the first inner wall 211 are joined to the outer wall 11 via joint walls 222. Thereby, the inner wall 211 is fixed to the outer wall 11. More specifically, each joint wall 222 is formed in a flat plate shape perpendicular to the second inner walls 212 and the direction connecting the midpoint Pc and the center Po of the outer wall 11.

A dielectric 13 having a predetermined dielectric constant is filled between the outer wall 11 and the inner wall 12. By arranging such a dielectric 13, the gap between the outer wall 11 and the inner wall 12 can be held more securely and stably.

With such a configuration, the radio wave is emitted in a direction from the two-dimensional slot antenna 20 toward the midpoint Pc of the front radome 10F, as the emitting direction.

Since the front radome 10F has the gap between the outer wall 11 and the inner wall 12 which is set to substantially λg/4 of the emission radio wave within the prescribed range from the midpoint Pc to the ends Pe on the circumference, as described above, a low-loss radio wave emission is performed within the range (Operation A). On the other hand, in the ranges from the prescribed positions to the ends Pe on the circumference, the gap between the outer wall 11 and the inner wall 12 (the second inner wall 212) is widened rather than substantially λg/4 and, thus, near the ends, the dielectric is arranged so as to approach closer to the center of the radome. Here, the dielectric has an edge effect (i.e., an effect to concentrate the electric field). Therefore, such a shape in which the dielectric approaches the center of the radome concentrates the electric field on a spatial area at the center of the radome (Operation B).

By such two operations (Operation A and Operation B), an opening area can be substantially narrowed and the emission radiation pattern can be widened, without hardly reducing the emission electric power. Note that the term "emission radiation pattern" as used herein refers to radiation pattern along the height directions of the front radome 10F and the two-dimensional slot antenna 20 (vertical radiation pattern).

Figure 5:
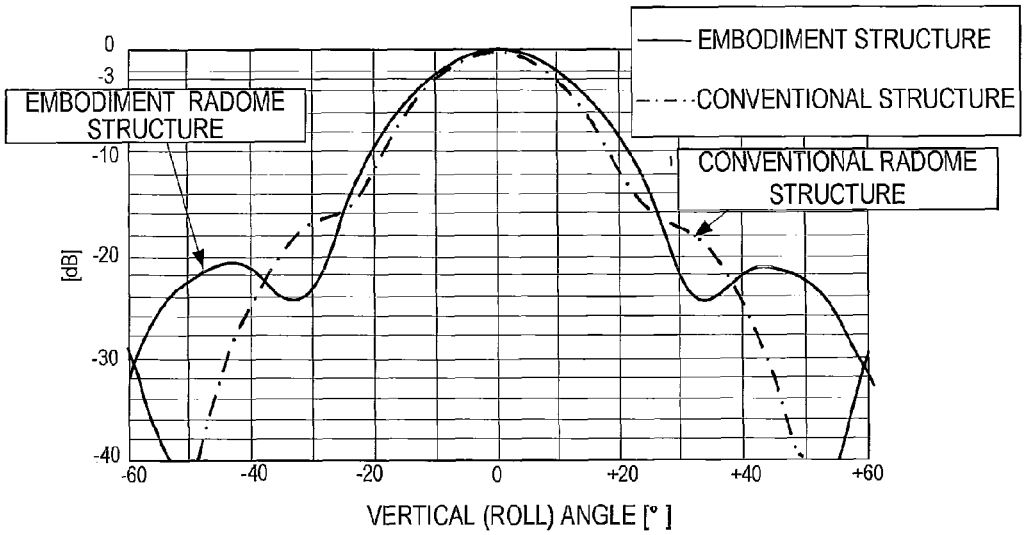
FIG. 5 is a graph showing vertical directivities of a front radome of this embodiment and a conventional radome.
Figure 6:
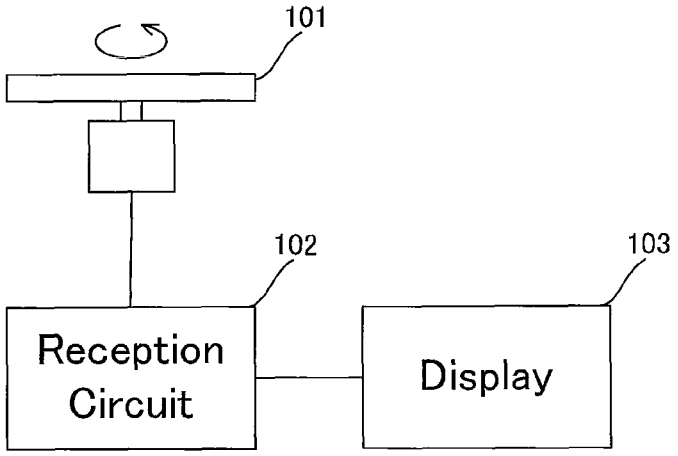
FIG. 6 is a block-diagram of a radar apparatus according to the present invention.

FIG. 5 is a graph showing vertical directivities of the front radome 10F of this embodiment and a conventional radome. The Roll angle in FIG. 5 corresponds to the vertical angle where the Roll angle=0° indicates the direction connecting the center Po and the midpoint Pc of the front radome 10F. Moreover, the conventional structure in FIG. 5 indicates a structure in which the gap between the outer wall and the inner wall is entirely constant.

As shown in FIG. 5, by using the configuration of the front radome 10F of this embodiment, the vertical radiation pattern can be widened. More specifically, by the conventional structure has the angle range where −3 dB can be secured being about 20° (from about −10° to about +10°), and, on the other hand, this embodiment has the widened angle range which is about 24° to 26° (from about −12° or −13° to about +12° or +13°).

Thereby, even if a movable body, such as a ship, where the antenna device 1 provided with the front radome 10F is mounted, rocks, the radio wave can be emitted to a target area more securely than before. As a result, if it is a radar apparatus, more secured target object detection is possible.

In this embodiment, the radome structure is shown in which the gap between the outer wall 11 and the inner wall 12 is constant up to the prescribed positions and gradually increases from the prescribed positions up to the ends Pe. However, other configurations may be adopted as long as it is a configuration in which the gap between the outer wall 11 and the inner wall 12 near the ends Pe is widened rather than at the center Pc of the outer wall 11. For example, only the inner wall may be formed in an ellipse, or may be formed with ellipses having different radii of curvature for the range from the center Pc to the prescribed positions and the ranges from the prescribed positions to the ends.

As described above, by using the configuration of this embodiment, the antenna device which excels in the emission properties can be implemented, while being reduced in size and weight as compared with the conventional configuration.

Moreover, in the above embodiments, the case where the outer wall 11 having the semi-circular side cross-section is used. However, the above embodiments may also adopt other structures such as a distorted semi-circular shape (substantially semi-circular shape) as long as the gap between the outer wall and the inner wall can have the relation described above.

Moreover, in the above description, the antenna device used for the ship radar is described, it may also be used for other movable bodies which may rock. FIG. 7 shows a block-diagram of a radar apparatus of the present invention, as an example applied to the ship radar.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. An antenna device, comprising:

a waveguide antenna having wall surfaces and for emitting a radio wave in a direction substantially perpendicular to an emission face that is one of wall surfaces of the waveguide antenna extending in an elongated direction of the waveguide antenna;

a plate-shape two-dimensional opening slots for beam formation formed in the waveguide antenna on the emission face side;

a power feed waveguide module arranged in the rear face of the waveguide antenna opposite from the emission face and for supplying electric power to the waveguide antenna; and a cylindrical radome having a substantially circular cross-section of a diameter that is substantially equal to a length of the emission face in a direction perpendicular to the elongated direction so that the waveguide antenna is contained in the radome so as to be arranged at substantially the center of the radome, and including an outer wall of a substantially semi-circular side cross-section on the emission face side;

a first inner wall, arranged inside of the outer wall and formed up to the prescribed position with a constant gap from the outer wall, and a second inner wall extending from the prescribed position as one end thereof and having a cross-section parallel to a direction from the substantially midpoint toward the center of the substantially semi-circular shape.

2. The antenna device of claim 1, wherein the power feed waveguide module includes:

a first power feed waveguide for transmitting a radio wave in a predetermined mode inputted from the outside; and a mode conversion waveguide for carrying out a mode conversion of the radio wave in the predetermined mode from the first power feed waveguide into an emission mode for the waveguide antenna.

3. The antenna device of claim 2, wherein the mode conversion waveguide is coupled to the waveguide antenna by power feed opening slots in the rear face of the waveguide antenna.

4. The antenna device of claim 2, wherein the mode conversion waveguide includes:

a coupling resonance module for coupling to the first power feed waveguide; and a power feed resonance module coupled to the waveguide antenna via the power feed opening slots.

5. The antenna device of claim 4, wherein a matching module for matching with the coupling resonance module is provided inside the power feed resonance module.

6. The antenna device of claim 2, wherein a gap between the outer wall and the first inner wall is wider near both ends on the circumference of the substantially semi-circular shape than at a substantially midpoint on the circumference of the substantially semi-circular shape.

7. The antenna device of claim 6, wherein the gap is constant in a prescribed range from the midpoint up to prescribed positions toward both the ends, and is widened as approaching both the ends from the prescribed range.

8. The antenna device of claim 2, further comprising a rotating module for rotating an integrated structural body including the waveguide antenna, the two-dimensional opening slot, the power feed waveguide module, and the radome that contains these so that the elongated direction is in a surface of the rotation.

9. The antenna device of claim 1, wherein a gap between the outer wall and the first inner wall is wider near both ends on the circumference of the substantially semi-circular shape than at a substantially midpoint on the circumference of the substantially semi-circular shape.

10. The radome of claim 9, wherein the gap is substantially λg/4 of the emitted electromagnetic wave within the prescribed range of the circumference from the midpoint toward the ends.

11. The radome of claim 10, wherein within the ranges of the circumference from the prescribed positions to the ends, the gaps between the outer wall and the first inner wall are widened rather than the substantially λg/4 of the emitted electromagnetic wave.

12. The antenna device of claim 10, wherein the gap is constant in a prescribed range from the midpoint up to prescribed positions toward both the ends, and is widened as approaching both the ends from the prescribed range.

13. The antenna device of claim 1, further comprising a rotating module for rotating an integrated structural body including the waveguide antenna, the two-dimensional opening slot, the power feed waveguide module, and the radome that contains these so that the elongated direction is in a surface of the rotation.

14. A radar apparatus, comprising:

the antenna device of claim 1; and a radio wave generating device for generating an emission radio wave for supplying electric power to the antenna device;

wherein the antenna device is provided so that the emission face of the waveguide antenna is oriented perpendicular to a horizontal direction and an antenna rotates in a horizontal plane while emitting electromagnetic wave horizontally.

15. A radar apparatus of claim 14, wherein the power feed waveguide module includes:

a first power feed waveguide for transmitting a radio wave in a predetermined mode inputted from the outside; and a mode conversion waveguide for carrying out a mode conversion of the radio wave in the predetermined mode from the first power feed waveguide into an emission mode for the waveguide antenna.

* * * * *